United States Patent [19]

Haag

[11] Patent Number: 4,655,533

[45] Date of Patent: Apr. 7, 1987

[54] ELECTRICAL CONNECTOR CONTAINING AN ANNULAR SHIELD AND METHOD OF MANUFACTURE THEREOF

[75] Inventor: Herbert Haag, Weinstadt, Fed. Rep. of Germany

[73] Assignee: ITT Industries, Inc., New York,, N.Y.

[21] Appl. No.: 343,973

[22] Filed: Jan. 29, 1982

[30] Foreign Application Priority Data

Feb. 4, 1981 [DE] Fed. Rep. of Germany ..... 3103668

[51] Int. Cl.[4] ..... H01R 13/46; H01R 43/04

[52] U.S. Cl. ..... 339/143 R; 29/882; 29/520

[58] Field of Search ..... 29/882, 862, 861, 520; 339/143 R, 258 R, 252 R; 174/35 GC

[56] References Cited

U.S. PATENT DOCUMENTS

| | | | |
|---|---|---|---|
| 2,164,414 | 7/1939 | Long | 29/520 X |
| 3,678,445 | 7/1972 | Brancaleone | 339/143 R |
| 4,239,318 | 12/1980 | Schwartz | 339/252 R X |
| 4,248,492 | 2/1981 | Snyder | 339/89 M |
| 4,326,768 | 4/1982 | Punako | 339/143 R |

*Primary Examiner*—Howard N. Goldberg
*Assistant Examiner*—Carl J. Arbes
*Attorney, Agent, or Firm*—T. L. Peterson

[57] ABSTRACT

A conductive shield is mounted in a groove formed in the outer surface of a connector housing. The end walls of the housing are undercut. The edges of the shield extend into the recesses formed by the undercut end-walls of the groove so that the shield is retained in the groove. An axially extending slot intersects the groove and recesses so that the shield may be inserted into the groove through the axially extending slot in the form of an elongated strip.

7 Claims, 7 Drawing Figures

ELECTRICAL CONNECTOR CONTAINING AN ANNULAR SHIELD AND METHOD OF MANUFACTURE THEREOF

BACKGROUND OF THE INVENTION

The present invention relates to electrical connectors with annular shields against electromagnetic interferences, safeguarding a reliably functioning ground connection between the two mating halves of the connector.

The U.S. Pat. Nos. 3,521,221; 3,678,444 and 4,106,839 disclose electrical connectors whose annular shields are formed of elongated sheet metal and embody spaced resilient fingers extending in one longitudinal direction of the connector.

In another conventional type of electrical connector, for obtaining a shielding, there is likewise used an annularly bent band formed from a sheet of resilient metal which is lanced to provide alternating slits which open at opposite edges of the band. For being mounted in position, this annular shield is expanded and slipped to such an extent on to the male half of the connector as to engage into a groove. Depending on the material of the connector housing, the annular shields are connected to the housing either by way of soldering or spot welding. It is also known, however, to snap such annular shields simply into the groove of the connector housing without establishing any mechanically firm connection.

Since the establishment of a rigid connection between the annular shield and the connector housing involves relatively high manufacturing costs and because, on the other hand, the loosely snapped in annular shields are often considered as being not in a sufficiently fixed position, it is the object of the invention to provide a more economical method of manufacturing an electrical connector containing an annular shield.

SUMMARY OF THE INVENTION

According to the invention the endwalls of an annular groove formed in the outer surface of a connector housing are undercut to form annular recesses facing each other. An axially extending recess is formed in the outer surface of the housing intersecting the annular groove and the undercut portions of the endwalls. A conductive shield strip is inserted tangentially into the groove through the axially extending recess until the strip surrounds the housing. The shield strip is formed with resilient fingers which extend outwardly through the groove. The strip is sufficiently wide so that its edges extend into the annular recesses formed in the undercut endwalls of the groove so that the shield is retained in the groove.

DESCRIPTION OF THE PREFERRED EMBODIMENTS

Figure 1:
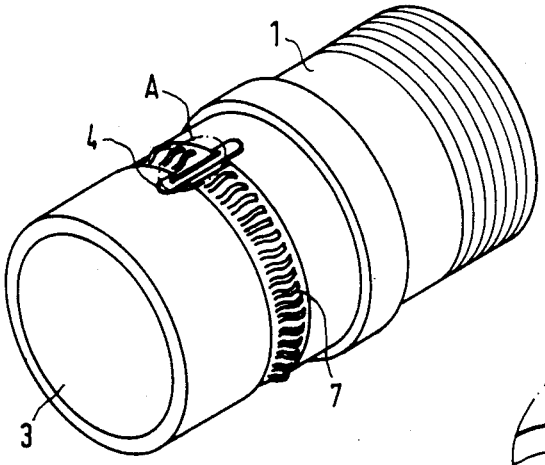
FIG. 1 shows the housing of one connector half provided with an annular shield, in a perspective representation.
Figure 2:
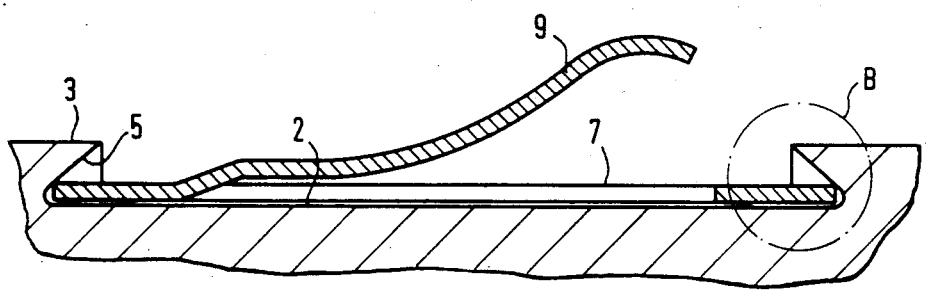
FIG. 2 shows part of the housing provided with an annular shield, in a sectional elevation.
Figure 2A:
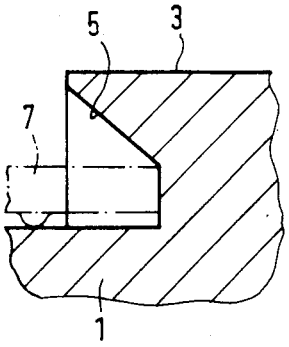
FIGS. 2*a*–2*c* show parts of housings with representations of examples of various cross-sectional shapes of an undercutting for retaining an annular shield, according to detail B of FIG. 2.
Figure 2B:
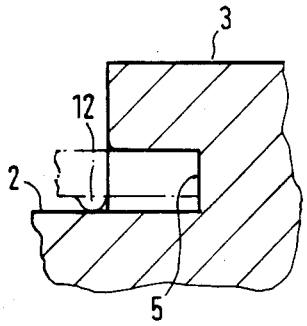
Figure 2C:
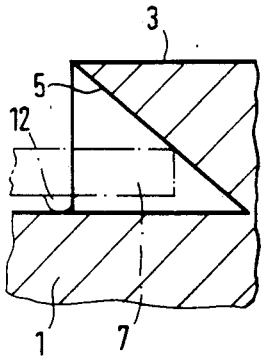
Figure 3:
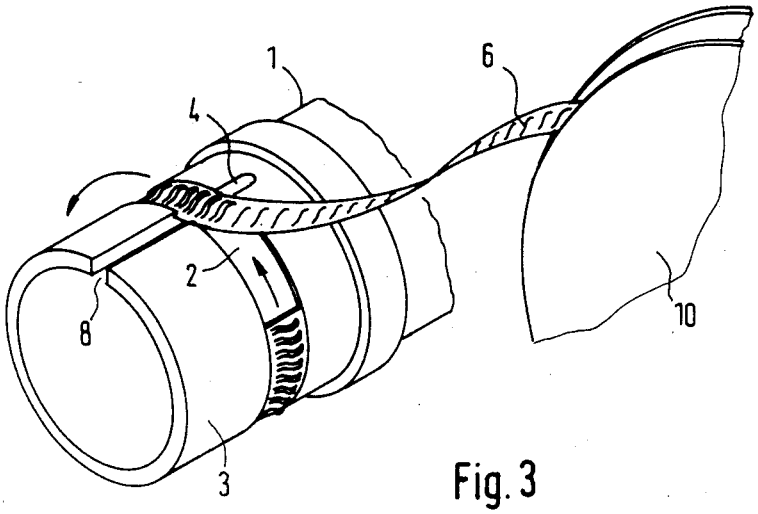
FIG. 3 shows the housing of one connector half while being provided with an annular shield, in a perspective representation.

In FIGS. 1 to 3 there is shown a housing of an electrical connector consisting of two halves which is indicated by the reference numeral 1. An annular groove 2 is formed in the outer surface of the front part 3 of the housing. Moreover, the housing 1 is provided with a recess 4 extending in the axial direction. The recess may be produced either in the course of the injection moulding of the housing 1, or later on by way of machining.

Either before or after the production of the recess 4, a trapezoidal undercutting 5 is cut into both side walls of the groove 2. The recess 4 extends transversely in relation to the groove 2 and provides, a mounting opening for the metal band 6 of the annular shield 7. The recess 4 is at least as long as the width dimension of the annular shield 7 and at least as deep as the annular groove 2.

It may also be suitable to provide the recess 4 or the mounting opening for the metal band 6 in the form of an axially extending slot 8 cut into the wall of the front part 3 of the housing 1 as shown in FIG. 3.

Figure 1A:
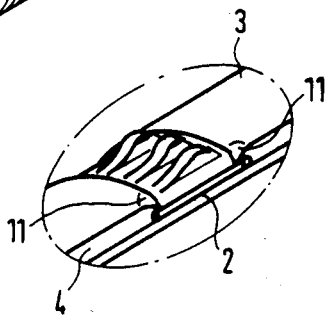
FIG. 1*a* shows the detail A of FIG. 1 on an enlarged scale.

Both the undercut groove 2 and the mounting opening permit the annular shield band with upstanding contacting spring members 9 to be produced in an automatic punching machine from a material supplied by the meter, and to insert the band directly into the mounting opening of the groove 2. Of course, in an advantageous manner, it is also possible for the annular shield band as coming from the automatic punching machine, to be spooled on to a supply reel or magazine roll 10 which may be transported to a separate connector assembling site (FIG. 3). There, the annular shield band material 6 as cut in the required length off the supply reel 10 is pushed to such an extent into the annular groove 2, that the beginning and the end of the band will come to lie opposite each other. As a protection against twisting, the lips formed by the undercutting are slightly wedged over at the end of the band forming noses 11 extending into the slot between the beginning and the end of the band as can be recognized from FIG. 1*a*.

The housing 1 as provided with the annular shield offers the advantage of a cost-effective manufacture permitting a mechanically simple and reliable mounting in position of the annular shield. In cases where the metal tape 6 is provided with dimples 12 projecting on the later inside of the annular shield 7, the longitudinal edges as convexly bent after the assembly, are resiliently pressed into the trapezoidal undercuttings 5 thus improving the electrical connection between the housing 1 and the annular shield 7.

What is claimed is:

1. An electrical connector member comprising:

a housing having an annular groove formed in the outer surface thereof behind the forward mating end of the housing;

the sidewalls of said groove being undercut to form annular recesses facing each other;

an axially extending recess formed in the outer surface of said housing intersecting said groove;

an annular conductive shield mounted in said groove with its edges extending into said annular recesses whereby said shield is retained in said groove;

said shield being formed from a strip having its opposite ends adjacent to each other;

said shield embodying resilient spring fingers extending outwardly from said groove;

said annular recesses in the sidewalls of said groove forming relatively narrow lips overlying the edges of said shield; and said axially extending recess being at least as long as the width of said shield and at least as deep as said groove, and intersecting said lips whereby said shield may be installed as a strip tangentially into said groove and annular recesses through said axially extending recess.

2. A connector member as set forth in claim 1 wherein:

the ends of said strip forming said shield are located at said axially extending recess;

the portions of said lips adjacent to said axially extending recess are deformd inwardly over the ends of said strip.

3. A connector member as set forth in claim 1 wherein:

said axially extending recess comprises a slot extending through the wall of said housing.

4. A connector member as set forth in claim 3 wherein:

said slot opens at said forward mating end of said housing.

5. A connector member as set forth in claim 1 wherein:

the outer diameters of said housing adjacent to the opposite sides of said groove are approximately equal.

6. A method of manufacturing an electrical connector member having an annular conductive shield comprising the steps of:

forming an annular groove in the outer surface of a connector housing;

undercutting the endwalls of said groove;

forming an axially extending recess in the outer surface of said housing intersecting said groove and the undercut portions of the endwalls thereof;

providing a conductive shield strip having resilient spring fingers extending outwardly from one side thereof; and inserting said strip tangentially into said groove through said axially extending recess with said fingers extending outwardly through said groove and until said strip substantially surrounds said housing.

7. A method as set forth in claim 6 wherein:

the lips formed by said annular recesses are deformed inwardly over said strip in the region adjacent to said axially extending recess.

* * * * *